US006260448B1

(12) United States Patent
Chaconas

(10) Patent No.: US 6,260,448 B1
(45) Date of Patent: Jul. 17, 2001

(54) TOP LOAD RATCHET WRENCH

(75) Inventor: Peter Constantine Chaconas, Glyndon, MD (US)

(73) Assignee: Hand Tool Design Corporation, Wilmington, DE (US)

( * ) Notice: Subject to any disclaimer, the term of this patent is extended or adjusted under 35 U.S.C. 154(b) by 0 days.

(21) Appl. No.: 09/468,459

(22) Filed: Dec. 21, 1999

(51) Int. Cl.[7] ..... B25B 13/46
(52) U.S. Cl. ..... 81/63; 81/60
(58) Field of Search ..... 81/60, 61, 62, 81/63, 63.1, 63.2

(56) References Cited

U.S. PATENT DOCUMENTS 4,869,138 * 9/1989 Farris ..... 81/63
4,903,554 * 2/1990 Colvin ..... 81/63
4,934,220 6/1990 Slusar et al. ..... 81/63.2
5,178,047 1/1993 Arnold et al. ..... 81/63.2
5,199,330 * 4/1993 Arnold et al. ..... 81/63
5,916,339 * 6/1999 Dumont ..... 81/63.2
5,921,158 * 7/1999 Slusar et al. ..... 81/63
6,145,412 * 11/2000 Cheng et al. ..... 81/63

* cited by examiner

*Primary Examiner*—Eileen P. Morgan
*Assistant Examiner*—Joni B. Danganan
(74) *Attorney, Agent, or Firm*—Leonard Bloom

(57) ABSTRACT

A ratchet wrench having the opening in the head formed from the top with the pawl being disposed adjacent to the gear within the opening. A retaining plate is disposed over the gear and pawl in the opening in the head. An aperture is formed in the cover plate aligned with a recess in the top of the pawl. A reversing lever with an offset tang is received in the aperture and engages the recess in the pawl. Alternate embodiments of the engagement of reversing lever with the pawl are disclosed. A quick release for sockets attached to the wrench is disclosed.

22 Claims, 9 Drawing Sheets

TOP LOAD RATCHET WRENCH

FIELD OF THE INVENTION

The present invention relates to a ratchet wrench and more particularly to a ratchet wrench in which the pawl and reversing lever are top loaded and the reversing lever is keyed to the pawl.

BACKGROUND OF THE INVENTION

There are numerous ratchet wrenches which have a pawl which is inserted in the top surface of the head of the wrench and which have dirt seals.

Slusar et al in U.S. Pat. No. 4,934,220 disclose a sealed ratchet wrench to reduce dirt contamination.

Arnold et al in U.S. Pat. No. 5,178,047 disclose a reversible ratchet wrench having a head portion with a drive member with teeth and a partially cylindrical pawl member having teeth which engage the teeth on the drive member. The stem of a lever is received in a cooperating bore in the pawl. A multi-sided shelf is formed on the stem, the shelf being received in the top of the pawl. A number of embodiments are disclosed and consideration is given throughout the reduction of the entry of dirt and other contaminants into the cavities.

However, further improvement is needed to facilitate more automated assembly of the tools and to improve the strength of the head of the wrench.

BRIEF SUMMARY OF THE INVENTION

It is an object of the invention to provide a ratchet wrench which is designed to facilitate automated assembly.

It is another object of the invention to provide a ratchet wrench which has increased strength.

It is a further object of the invention to provide a ratchet wrench with reduced possibility for contamination by dirt.

In accordance with the teachings of the present invention, there is disclosed a ratchet wrench having a handle and a head connected thereto, the head having a top surface, a bottom surface and an opening therebetween. An improvement to the ratchet wrench is the opening formed from the top surface of the head. The opening has two overlapping portions, a first portion being distal from the handle and being a through opening, the second portion being a blind bore proximal to the handle. A gear has a tang formed on a bottom surface thereof. The gear is disposed in the first portion of the opening with the tang extending outwardly from the bottom surface of the head. A pawl has a keying means formed on a top surface. The pawl is disposed in the second portion of the opening in the head with the keying means being oriented toward the top surface of the head. A retaining plate is disposed over the gear and the pawl and is received in the opening in the head. The retaining plate has a larger segment and a smaller segment. The larger segment of the plate is received in the first portion of the opening in the head. The smaller segment of the plate is received in the second portion of the opening in the head and has an aperture formed therein. The aperture is aligned with the keying means in the top surface of the pawl. A reversing lever has an engaging means formed on a bottom surface. The reversing lever is disposed in the second portion of the opening in the head wherein the engaging means extends through the aperture in the retaining plate and is engaged with the keying means in the top surface of the pawl. The reversing lever is retained therein. Means are provided to hold the retaining plate on the head of the wrench.

In further accordance with the teachings of the present invention, there is disclosed a ratchet wrench comprising a handle and a head connected thereto. The head has a top surface, a bottom surface and an opening therebetween. The opening is formed from the top surface of the head. The opening has two overlapping portions, the first portion being distal from the handle and the second portion being proximal to the handle. A pawl has a keying means formed on a top surface. The pawl is disposed in the second portion of the opening in the head with the keying means being oriented toward the top surface of the head. A reversing lever has a depending tang. The tang is received in the keying means in the pawl. Means are provided to retain the pawl in the head of the wrench.

In still further accordance with the teachings of the present invention, there is disclosed a ratchet wrench having a handle with a head connected thereto. An opening is formed in the head. A pawl is disposed in a portion of the opening, the pawl having a keying means formed on an upper surface thereof. A reversing lever has a stem formed on a bottom surface. The stem has an engaging means formed thereon. A retaining plate has an aperture formed therein, the aperture being aligned with the keying means in the top of the pawl. The reversing lever is disposed in the portion of the opening in the head such that the stem extends through the aperture in the retaining plate and is received in the keying means in the pawl. In this manner the reversing lever is retained by the retaining plate and further, pivotal movement of the reversing lever produces concomitant pivotal movement of the pawl to provide forward and reverse ratcheting of the wrench.

Additionally, in accordance with the teachings of the present invention, there is disclosed a ratchet wrench having a handle and a head connected thereto, the head having a top surface, a bottom surface and an opening therebetween. The opening is formed from the top surface of the head. The opening has two overlapping portions, a first portion being distal from the handle and being a through opening, the second portion being a blind bore proximal to the handle. A gear has a top surface and a bottom surface, a tang formed on the bottom surface thereon. The gear is disposed in the first portion of the opening with the tang extending from the bottom surface of the head. The tang has a transverse opening therein. A first detent ball is disposed in the transverse opening wherein a socket is removably retained on the tang. A pawl is disposed in the second portion of the opening in the head and engages the gear. A retaining plate is disposed over the gear and the pawl is received in the opening in the head. A blind bore is formed axially in the gear and extends into the tang. A spring is disposed in the blind bore supporting a second detent ball, the second detent ball contacting the first detent ball. A shaft having a first end and a second end is disposed in the blind bore in the gear. The first end contacts the second detent ball. The second end is connected to a button, the button extending outwardly from the top surface of the gear. The button has a flange formed on a bottom surface thereof adjacent to the second end of the shaft. The flange is disposed and retained in the blind bore in the gear. Pressure on the button compresses the spring and moves the second detent ball lower in the blind bore such that the first detent ball moves toward the blind bore and releases the socket from the tang.

These and other objects of the present invention will become apparent from a reading of the following specification taken in conjunction with the enclosed drawings.

BRIEF DESCRIPTION OF THE DRAWINGS

FIG. 13 shows the tang of the reversing lever being introduced into the aperture in the plate.

FIG. 14 shows the tang shelf of the reversing lever received in the aperture in the plate.

FIG. 15 shows the tang shelf of the reversing lever received in the aperture in the plate wherein the reversing lever has been turned from FIG. 13.

DESCRIPTION OF THE PREFERRED EMBODIMENTS

Figure 1:
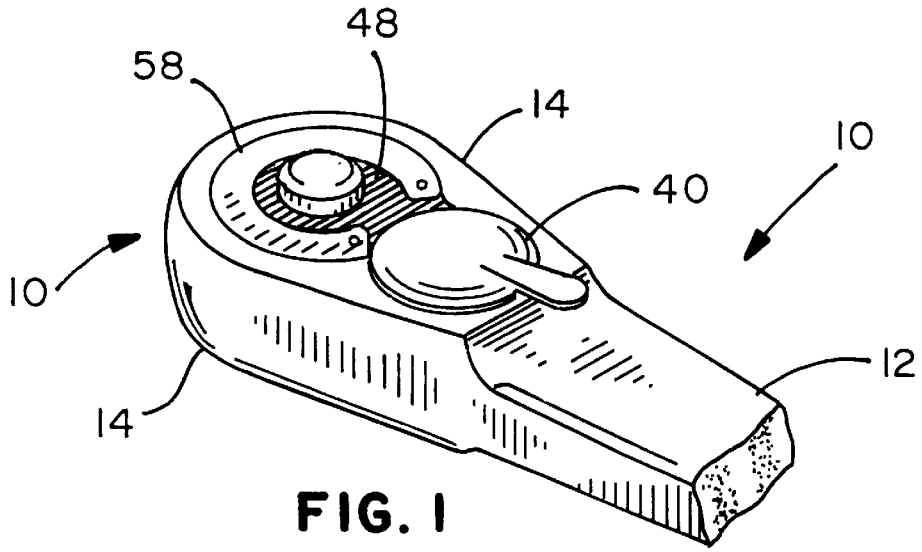
FIG. 1 is a perspective view of the ratchet wrench of the present invention.
Figure 2:
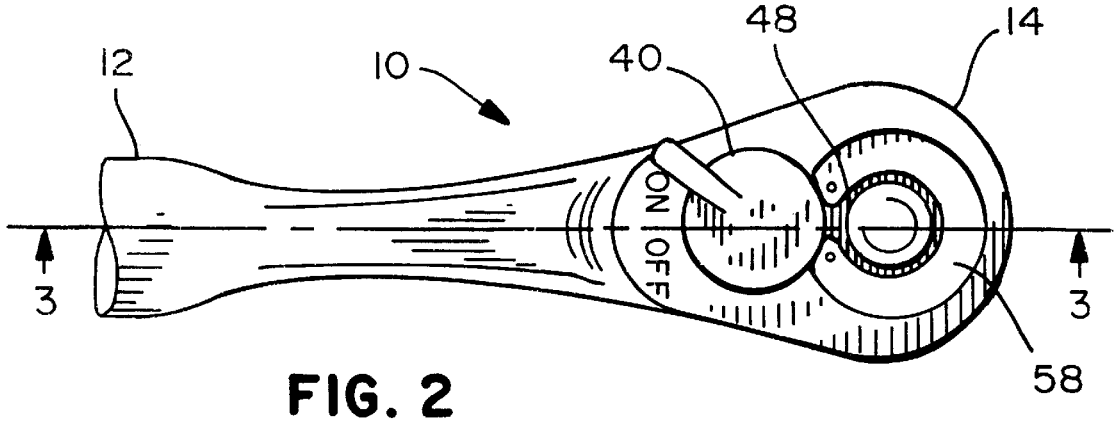
FIG. 2 is a top plan view of the ratchet wrench of the present invention.
Figure 3:
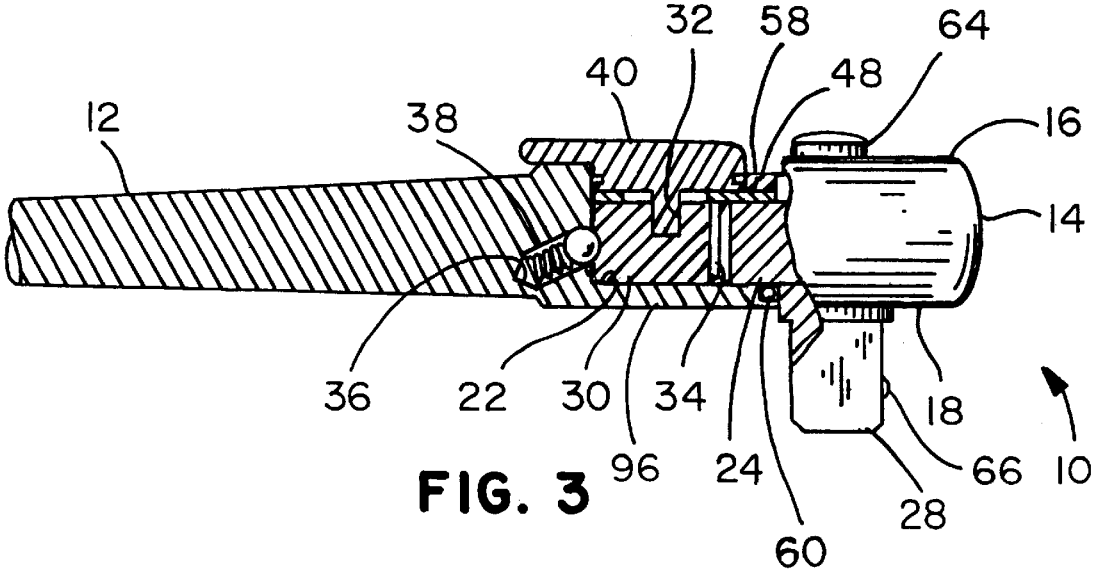
FIG. 3 is a cross-sectional view taken across the lines 3—3 of FIG. 2.
Figure 6:
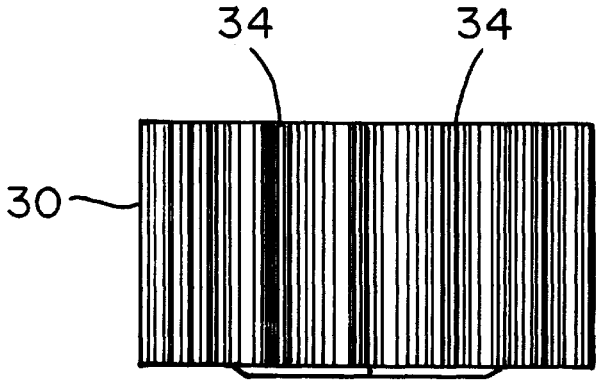
FIG. 6 is a front elevation view of the pawl.
Figure 4:
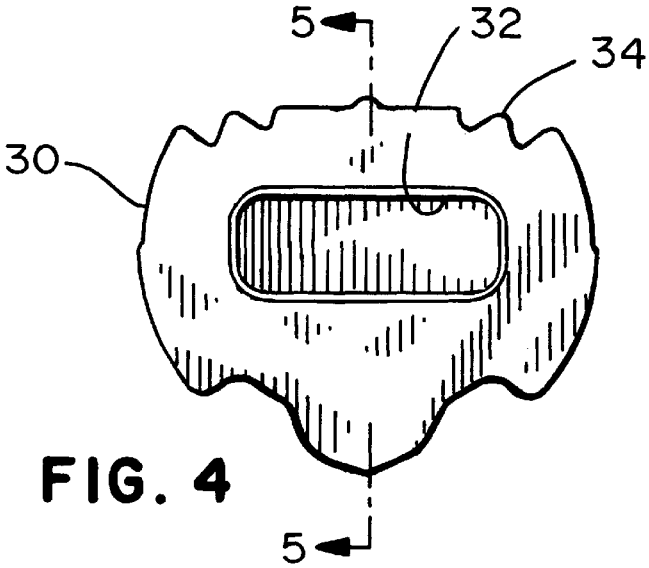
FIG. 4 is a top plan view of the pawl.
Figure 5:
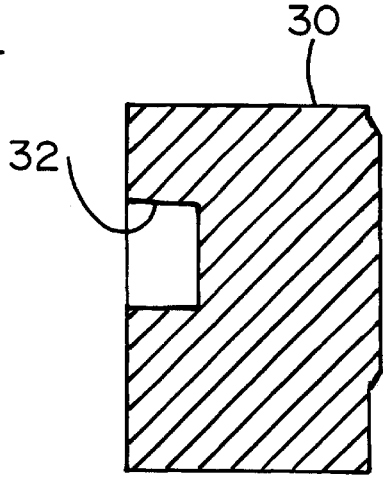
FIG. 5 is a cross-sectional view along the lines 5—5 of FIG. 4.
Figure 7:
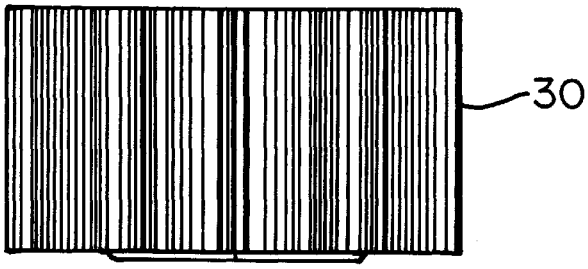
FIG. 7 is a back elevation view of the pawl.
Figure 8:
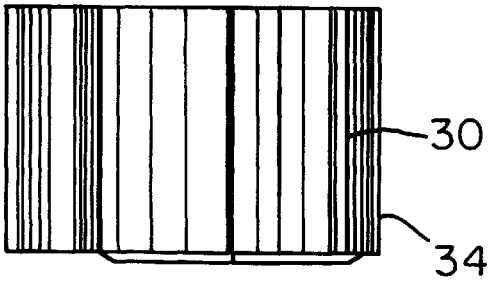
FIG. 8 is a side elevation view of the pawl.
Figure 9:
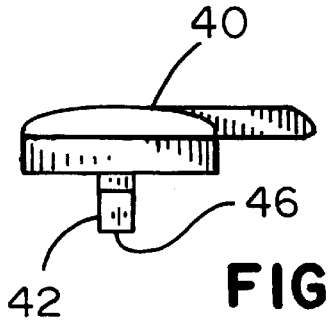
FIG. 9 is a side elevation view of the reversing lever.
Figure 10:
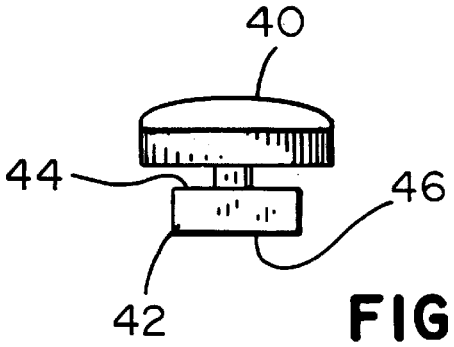
FIG. 10 is a front elevation view of the reversing lever.
Figure 11:
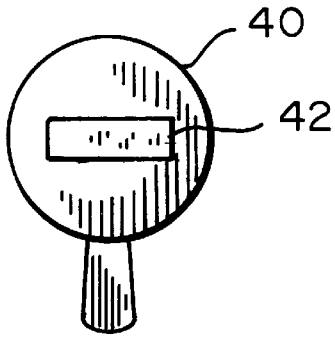
FIG. 11 is a bottom plan view of the reversing lever.
Figure 16:
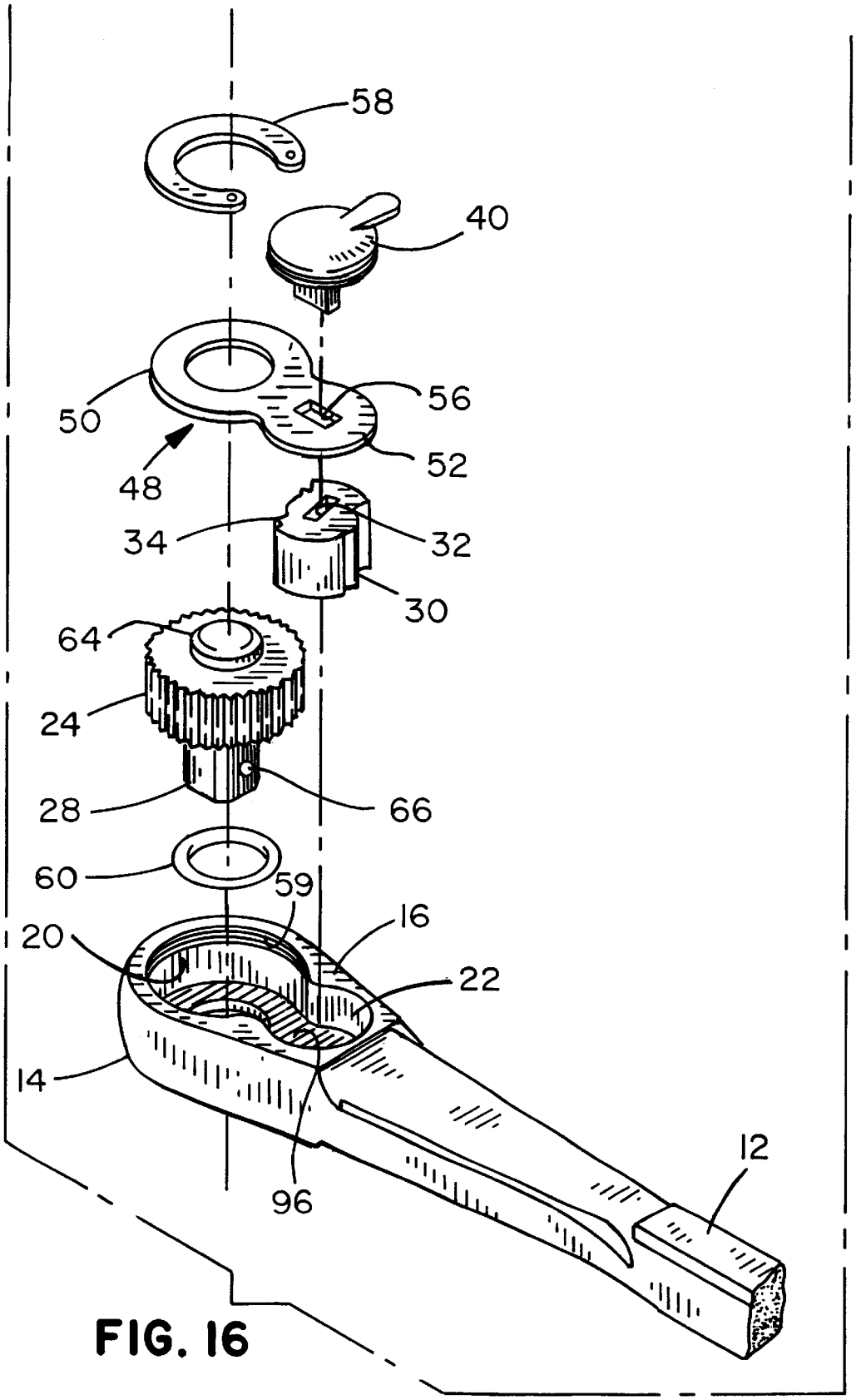
FIG. 16 is an exploded view of the ratchet wrench of the present invention.

Referring now to FIGS. 1–3, the ratchet wrench 10 of the present invention has a low profile. The handle 12 is connected to the head 14. The head 14 has a top surface 16 and a bottom surface 18. An opening is formed in the head 14 from the top surface 16. The opening has two overlapping portions. The first portion 20 of the opening (see FIG. 16) is distal from the handle 12 and is a through opening between the top surface 16 and the bottom surface 18 of the head 14. The second portion 22 of the opening is proximal to the handle 12 and preferably, is a blind bore which does not extend through the bottom surface 18 of the head 14.

A gear 24 is disposed in the first portion 20 of the opening. The gear 24 has a plurality of spaced-apart teeth formed about the circumference thereof. A tang 28 is formed on the bottom of the gear 24 with the tang 28 extending outwardly from the bottom surface 18 of the head 14. The gear 24 may have a boss formed on the top surface thereof. The boss, if present, is disposed near the top surface 16 of the head 14.

As shown in FIGS. 4–8, a pawl 30 has a keying means 32 formed in a top surface of the pawl 30. Preferably, the keying means 32 is an elongated groove which is oriented across the pawl (that is, between the sides). The teeth 34 on the pawl 30 engage the teeth on the gear 24.

A blind bore 36 is formed in the handle 12 communicating with the second portion 22 of the opening. A detent means 38 is disposed in the blind bore 36 to urge the teeth on the pawl 30 into contact with the teeth on the gear 24.

As shown in FIGS. 1, 3, and 9–11, the reversing lever 40 is disposed in the second portion of the opening 22. In one embodiment, the reversing lever 40 has an undercut tang 42 formed on a lower surface of the reversing lever 40. The undercut tang 42 has a shelf or ledge 44 formed thereon. The configuration of the shelf or ledge 44 is not critical. It must be able to interface or bear on the lower surface of the retaining plate 48 as will be described. The distal end 46 of the tang 42 is received in the keying means 32 in the top of the pawl 30.

Figure 12:
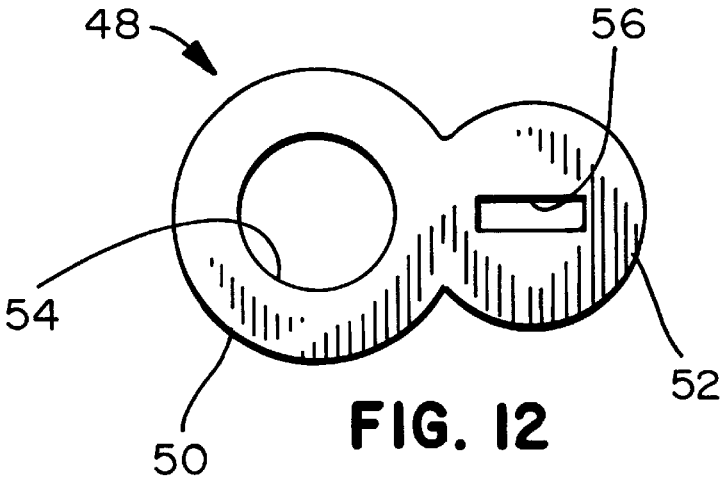
FIG. 12 is a top plan view of the plate.

A retaining plate 48 is disposed in the opening in the head 14 above the gear 24 and the pawl 30 (FIGS. 2, 3 and 12). The retaining plate 48 has a larger diameter segment 50 and a smaller diameter segment 52. The larger segment 50 is disposed in the first portion 20 of the opening and the smaller segment 52 is disposed in the second portion 22 of the opening. An aperture 56 is formed in the approximate center of the smaller segment 52. When the retaining plate 48 is disposed in the opening in the head 14, the aperture 56 is axially aligned with the keying means (recess) 32 in the pawl 30 which is under the retaining plate 48. Preferably, the retaining plate is in the shape of a FIG. 8.

Figure 13:
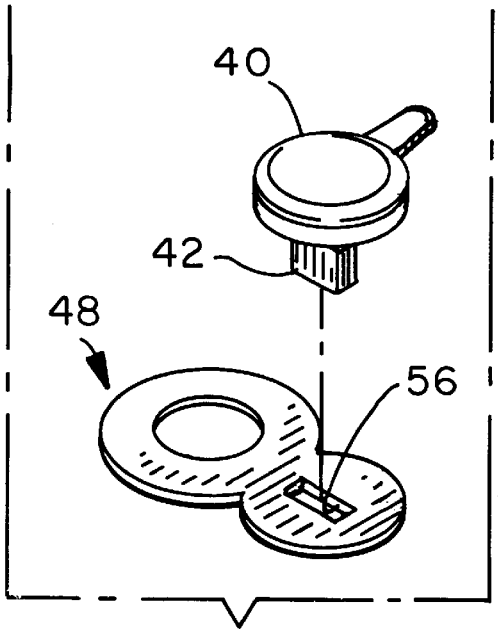
FIGS. 13–15 are a sequence of views showing the insertion and retention of the reversing lever with respect to the retaining plate.
Figure 14:
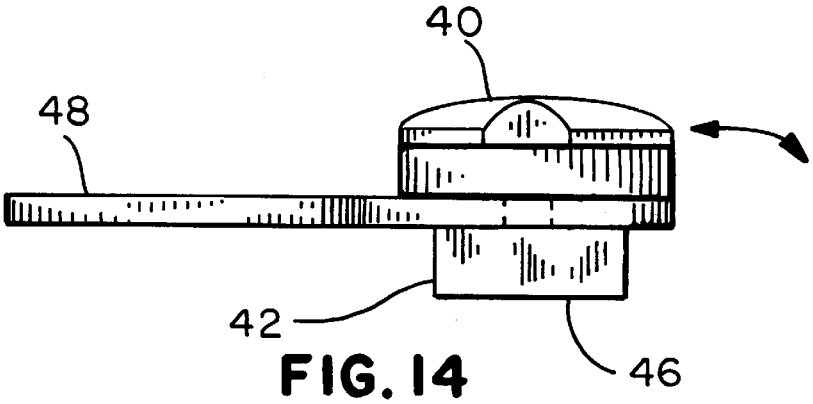
Figure 15:
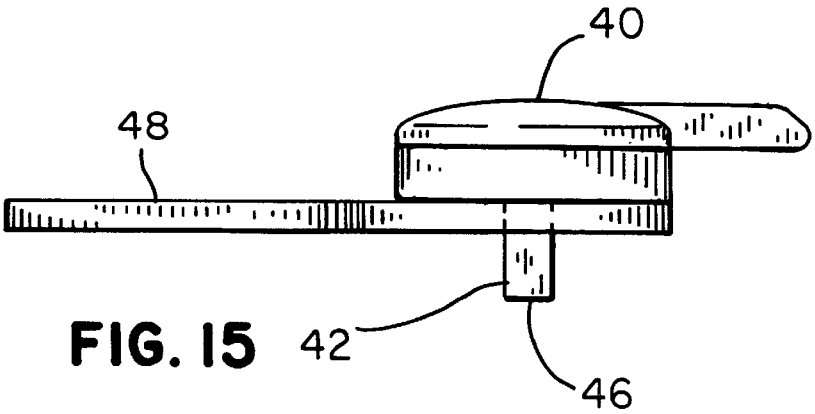

The undercut tang 42 on the reversing lever 40 is received in the aperture 56 in the smaller segment 52 of the retaining plate 48 such that the undercut tang 42 passes through the aperture 56 (FIGS. 13–15). The reversing lever 40 is rotated so that the ledge 44 on the tang 42 is engaged beneath the retaining plate 48 with the ledge 44 bearing against the underside of the plate 48. The distal end 46 of the tang is received in the keying means (recess) 32 in the pawl 30.

In this manner, the reversing lever 40 is axially secured to the wrench and further pivotal movement of the reversing lever produces concomitant movement of the pawl to provide forward and reverse ratcheting of the wrench.

The reversing lever 40 may have stem 41 or an undercut tang 42 formed on the lower surface thereof. The stem 41 may have alternate embodiments.

Figure 17:
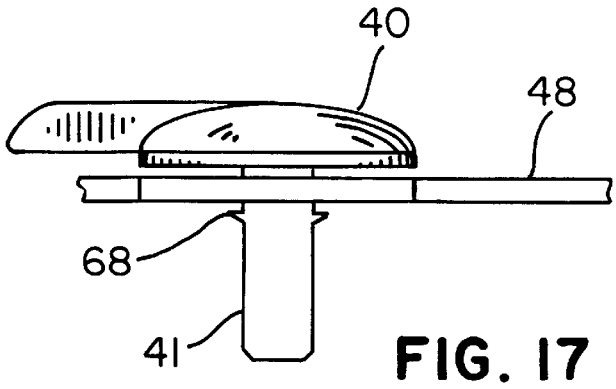
FIG. 17 is a side elevation view of an embodiment with barbs on the upper portion of the stem of the reversing lever.

As shown in FIG. 17, at least one barb 68 is formed on the stem 41 spaced a small distance apart from the lower surface of the reversing lever. The retaining plate 48 is received in the space between the lower surface of the reversing lever and the at least one barb. The reversing lever 40 is connected to the retaining plate 48 by a snap fit in the assembly of the wrench. The opposite end of the stem engages the keying means 32 on the pawl 30.

Figure 18:
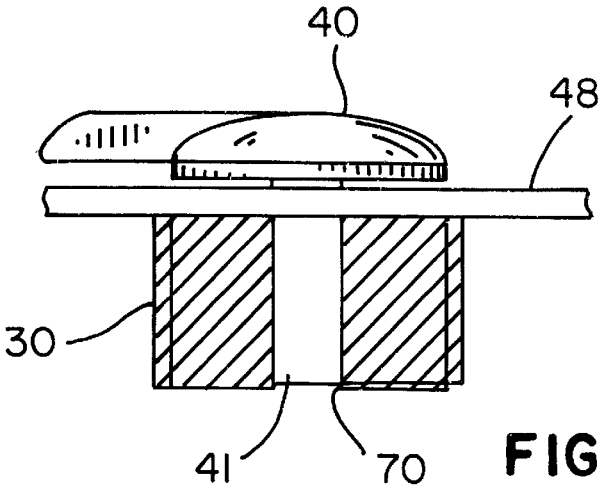
FIG. 18 is a partial cutaway view of an embodiment with the stem of the reversing lever press fit into the pawl.

Alternately, as shown in FIG. 18, the stem 41 extends through the aperture 56 or opening in the smaller diameter segment 52 of the retaining plate 48 and is press fit into an axial bore 70 in the pawl 30.

Figure 19:
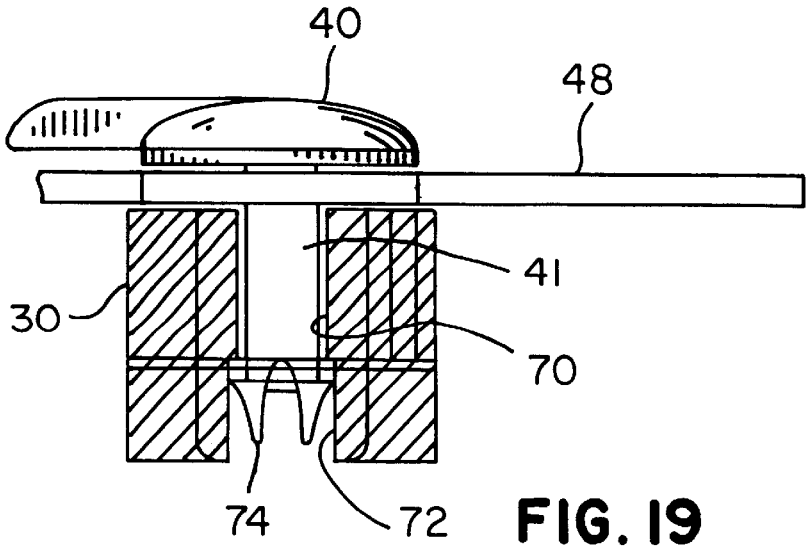
FIG. 19 is a partial cutaway view of an embodiment with barbs on the end of the stem of the reversing lever engaged in a recess in the pawl.

In still another embodiment (FIG. 19) a recess 72 is formed in the lower surface of the pawl 30 communicating with the bore 70 in the pawl 30. The stem 41 of the reversing lever has a flexible barb 74 formed on an end of the stem distal from the reversing lever 40. The stem 41 extends through aperture or opening 56 in the smaller diameter segment 52 of the retaining plate 48 and the flexible barb 74 engages the recess 72 and retains the reversing lever in the pawl. The vertical side of the stem 41 and the vertical sides of the bore 70 in the pawl have engaging outer surfaces such that turning of the reversing lever produces similar turning of the pawl.

The retaining plate 48 is secured to the head of the wrench 10 by a snap ring 58 which is received in a groove 59 formed circumferentially near the top surface 16 within the first portion 20 of the opening in the head.

It is further preferred that a seal 60 (or "O" ring) be disposed between the tang 28 on the lower surface of the gear 24 and the bottom surface 18 of the head. This seal is to prevent the ingress of dirt into the wrench. Further, since there is no opening in the bottom surface 18 of the head for the pawl, the avoidance of dirt is greater with the present invention than with prior art wrenches which have such a pawl opening. The retaining plate 48 is proximal to the upper surface 16 of the wrench which is farther from the work surface as compared to other wrenches and the ingress of dirt into the wrench is further reduced in the present invention.

Because of the top loading of the gear 24, pawl 30 and detent means 38 into the opening in the head of the wrench, and due to the configuration of the undercut tang 42 or stem 41 on the pawl and the keying means, aperture or opening 56 in the retaining plate 48, the automated assembly of the wrench of the present invention is facilitated. Forming the opening in the head 14 can be accomplished in a single set up. The gear 24 and pawl 30 can be inserted by automated processes. Similarly once the gear 24, pawl 30 and detent 38 are in place in the head 14, the tang 42 or stem 41 on the reversing lever 40 may be inserted into the aperture 56 of the retaining plate and rotated for alignment with the pawl 30 in the head. The retaining plate 48 and reversing lever 40 are dropped in place and held in place with the snap ring 58. The number of manual operations is reduced and savings in assembly are realized.

Furthermore, the resulting ratchet wrench has greater mechanical strength than wrenches which have a pawl bore which is a through opening. The additional load bearing ledge 96 thickness under the pawl 30 and partially under the gear 24 increases the rigidity of the head 14 of the wrench 10. The resulting ratchet has greater mechanical strength than comparable wrenches which have their ledge, minimized by large through holes, thinned for mounting of typical reversing levers and weakened by the additional hole required for the typical connection of the pawl to the lever. The ledge 96 of the preferred embodiment, not being thinned and weakened by typical ratchet features for mounting of the reversing lever, provides greater rigidity and structural integrity to the head. Thus, more accurate presentation of the gear to the pawl is maintained during periods of high loading, improving the engagement of the gear to pawl teeth which is typically compromised under high load conditions in currently produced ratchets. Also, accurate and positive engagement of the pawl 30 is achieved by the distal end 46 of the tang 42 on the reversing lever 40. This is a further advantage of the present invention.

The reversing lever 40 is partially recessed in the second portion 22 of the opening in the head which provides a slight degree of journaling of the reversing lever 40. In this manner, bearing surfaces are provided to protect the reversing lever against side-way blows. Also, the partial recessing contributes to lowering the profile of the wrench 10.

Figure 20:
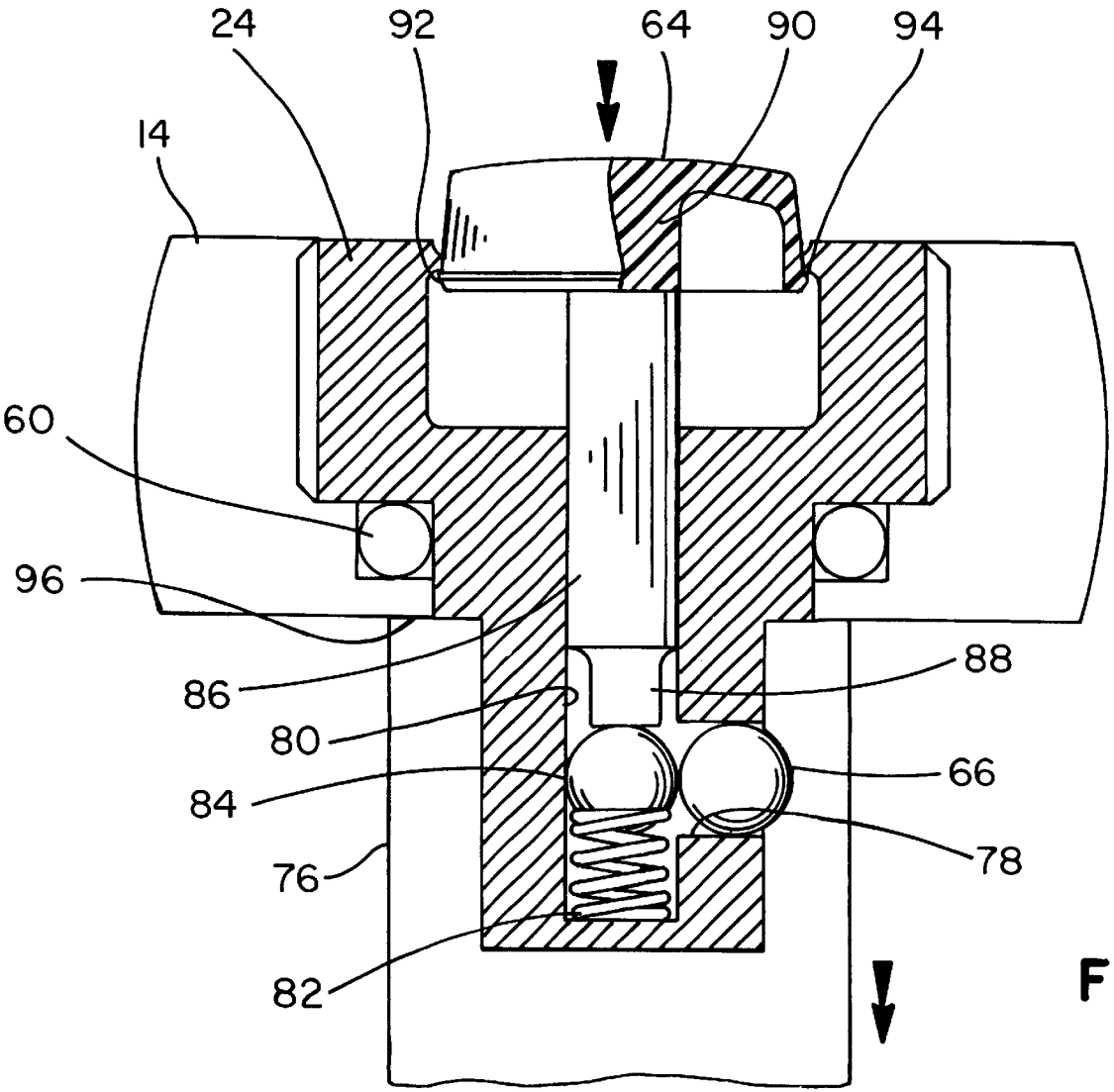
FIG. 20 is a partial cutaway view showing schematically for ease of illustration, an embodiment of the quick release.
Figure 21:
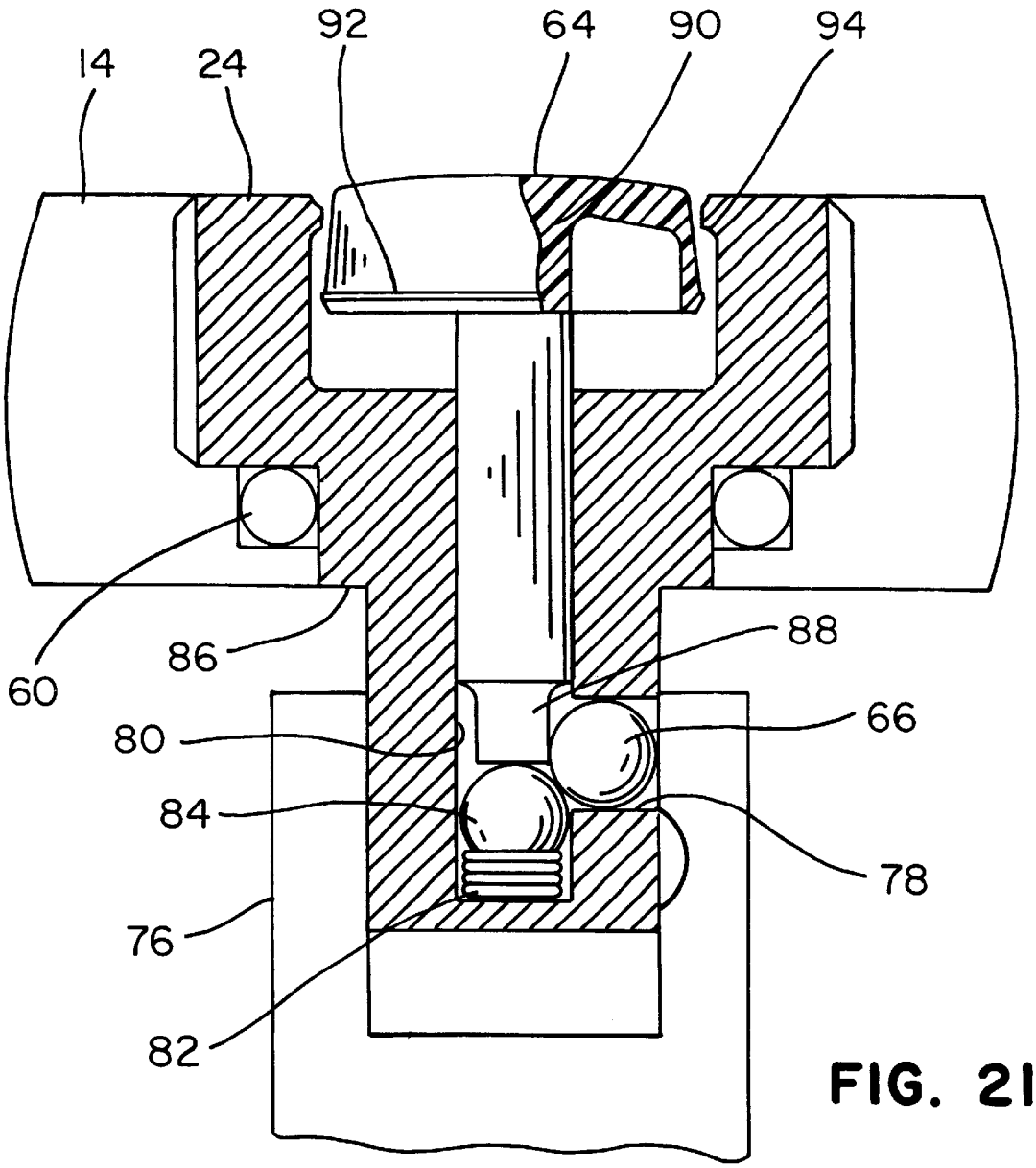
FIG. 21 is a view of FIG. 20 with the button being depressed to release the socket.
Figure 22:
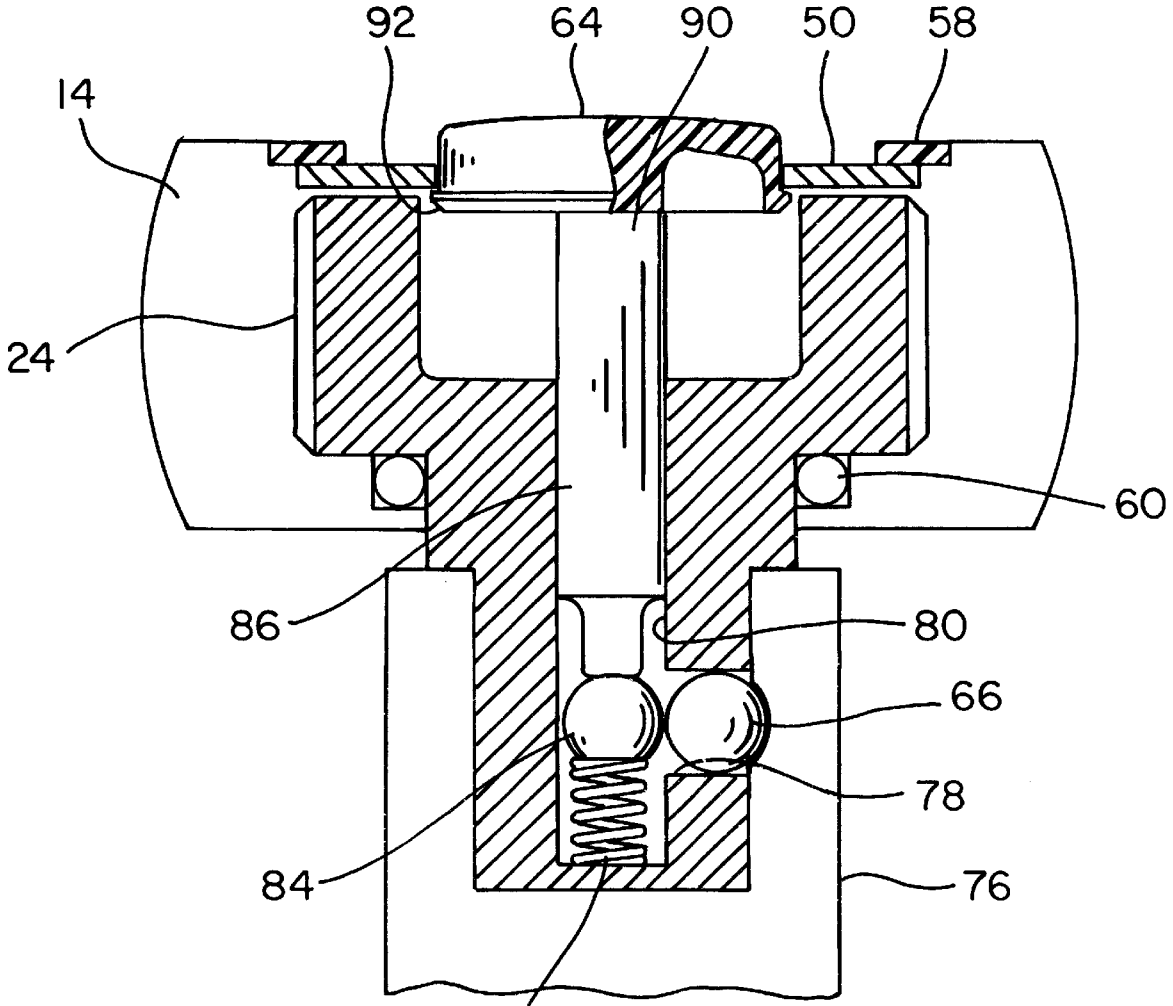
FIG. 22 is a partial cutaway view showing schematically for ease of illustration, an alternate embodiment of the quick release.

The wrench 10 is used to drive a socket 76 which is removably connected to the tang 28 formed on the bottom of the gear 24. In order to more rapidly and easily remove the socket 76, a quick release may be incorporated into the wrench. As shown in FIGS. 20–21, the tang 28 has a transverse opening 78 formed therein in which a first detent ball 66 is disposed. A blind bore 80 is formed axially in the gear 24 extending into the tang beyond the transverse opening 78. The blind bore 80 communicates with the transverse opening 78 and is perpendicular thereto. A resilient means 82 such as a coil spring is disposed in the bottom of the blind bore 80 in the tang 78. A second detent ball 84 is supported on the resilient means within the blind bore. The second detent ball 84 contacts the first detent ball 66, the balls being approximately side-by-side when the resilient means is in a normal position. A shaft 86 having a first end 88 and an opposite second end 90 is disposed in the blind bore 80 in the gear 24. The first end 88 abuts the second detent ball 84 opposite from the resilient means. The second end 90 of the shaft 86 is connected to a button 64 which extends outwardly from the top of the gear 84 above the top surface 16 of the head 14. A flange 92 is formed on the bottom surface of the button near the second end 90 of the shaft 86.

In one embodiment (FIGS. 20–21), the bore 80 within the gear 24 is undercut in an upper portion adjacent to the button 64. A circumferential ledge 94 is thereby formed within the bore. The flange 92 on the button 64 is disposed under the ledge 94 to retain the button 64 in the gear 24. The button 64 preferably is formed from a plastic material such that the flange 92 flexes sufficiently to provide a snap interface with the ledge 94.

When pressure is applied to the button 64, the shaft 86 presses the second detent ball 84 against the resilient means 82, compressing the resilient means 82 (FIG. 21). The second detent ball 84 moves lower in the blind bore 80 toward the blind end of the bore such that the second detent ball 84 is not aligned with the transverse opening 78. The first detent ball 66 moves toward the blind bore 80 in the gear 74 and disengages from the socket 76 such that the socket 76 is released from the tang 28.

In an alternate embodiment, the quick release differs in that the bore within the gear 24 is not undercut and there is no circumferential ledge. However, the larger diameter segment 50 of the retaining plate 48 has an opening therein with a diameter which is slightly greater than the diameter of the button's upper surface but is slightly smaller than the diameter of the flange 92 on the button 64 and slightly smaller than the diameter of the bore 80 in the upper portion of the gear 24. In this manner, the button 64 extends through the retaining plate 48 but is held in place by the flange 92 which abuts the lower surface of the retaining plate 82. The functioning of the quick release by pressing on the button 64 is the same as in the above-described embodiment.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a ratchet wrench having a handle and a head connected thereto, the head having a top surface, a bottom surface and an opening therebetween, the improvement comprising:

the opening being formed from the top surface of the head, the opening having two overlapping portions, a first portion being distal from the handle and being a through opening, the second portion being a blind bore proximal to the handle, a gear having a tang formed on a bottom surface thereon, the gear being disposed in the first portion of the opening with the tang extending from the bottom surface of the head, a pawl having a keying means formed therein, the pawl being disposed in the second portion of the opening in the head with the keying means being oriented toward the top surface of the head, a retaining plate being disposed over the gear and the pawl and being received in the opening in the head, the retaining plate having a larger segment and a smaller segment, the larger segment of the retaining plate being received in the first portion of the opening in the head, the smaller segment of the retaining plate being received in the second portion of the opening in the head and having an aperture formed therein, the aperture being aligned with the keying means in the top surface of the pawl, a reversing lever having an engaging means formed on a bottom surface, the reversing lever being disposed in the second portion of the opening in the head wherein the engaging means extends through the aperture in the retaining plate and is engaged with the keying means in the pawl, wherein the reversing lever is retained therein, and means to hold the retaining plate on the head of the wrench.

2. The ratchet wrench of claim 1, further comprising a sealing means disposed in the first portion of the opening in the head from the bottom surface of the head and around the tang on the gear wherein a seal is formed to prevent the entry of dust and dirt into the opening in the head.

3. The ratchet wrench of claim 1, wherein the retaining plate has a figure eight shape.

4. The ratchet wrench of claim 1, further comprising a quick-release means being disposed in the gear wherein a socket retained on the tang on the gear may be easily released.

5. The ratchet wrench of claim 4, wherein the quick-release means has a button disposed in the gear, the button being retained in the gear by a snap fitting.

6. The ratchet wrench of claim 4, wherein the quick-release means has a button disposed in the gear, the button having a flange disposed beneath the retaining plate.

7. The ratchet wrench of claim 1, wherein the engaging means on the reversing lever is an undercut tang having a distal end, the keying means on the pawl being an elongated groove in the top surface of the pawl, such that the distal end of the reversing lever engages the elongated groove in the top surface of the pawl, and pivotal movement of the reversing lever produces concomitant movement of the pawl to provide forward and reverse ratcheting of the wrench.

8. The ratchet wrench of claim 1, wherein the engaging means on the reversing lever is a stem formed on the bottom surface thereof, the keying means on the pawl being an axial bore in the pawl, the stem being press fit in the bore such that pivotal movement of the reversing lever produces concomitant movement of the pawl to produce forward and reverse ratcheting of the wrench.

9. In a ratchet wrench having a handle and a head connected thereto, the head having a top surface, a bottom surface and an opening therebetween, the improvement comprising:

the opening being formed from the top surface of the head, the opening having two overlapping portions, a first portion being distal from the handle and being a through opening, the second portion being a blind bore proximal to the handle, a gear having a tang formed on a bottom surface thereon, the gear being disposed in the first portion of the opening with the tang extending from the bottom surface of the head, a pawl having a keying means formed therein, the pawl being disposed in the second portion of the opening in the head with the keying means being oriented toward the top surface of the head, a retaining plate being disposed over the gear and the pawl and being received in the opening in the head, the retaining plate having a larger segment and a smaller segment, the larger segment of the retaining plate being received in the first portion of the opening in the head, the smaller segment of the retaining plate being received in the second portion of the opening in the head and having an aperture formed therein, the aperture being aligned with the keying means in the top surface of the pawl, a reversing lever having an engaging means formed on a bottom surface, the reversing lever being disposed in the second portion of the opening in the head wherein the engaging means extends through the aperture in the retaining plate and is engaged with the keying means in the pawl, wherein the reversing lever is retained therein, the engaging means on the reversing lever is a stem formed on the bottom surface thereof, the stem having a distal end having a flexible barb formed thereon, the stem having vertical sides having an engaging outer surface, the pawl having an axial bore and a recess formed in a lower surface of the pawl, the axial bore communicating with the recess, the axial bore in the pawl having vertical sides having engaging surfaces formed thereon, the stem being received in the axial bore in the pawl, the flexible barb on the stem engaging the recess in the pawl such that the reversing lever is retained on the wrench, the vertical sides on the stem engaging the vertical sides of the axial bore in the pawl such that pivotal movement of the reversing lever produces concomitant movement of the pawl to produce forward and reverse ratcheting of the wrench, and means to hold the retaining plate on the head of the wrench.

10. A ratchet wrench comprising a handle and a head connected thereto, the head having a top surface, a bottom surface and an opening therebetween, the opening being formed from the top surface of the head, the opening having two overlapping portions, the first portion being distal from the handle and the second portion being a blind bore proximal to the handle, a pawl having a keying means formed on a top surface, the pawl being disposed in the second portion of the opening in the head with the keying means being oriented toward the top surface of the head, and means to retain the pawl in the head of the ratchet wrench, wherein a retaining plate is disposed in the opening, the retaining plate having an aperture formed therein, the aperture being aligned with the keying means in the top surface of the pawl, the tang on the reversing lever having an interference fit with the keying means in the pawl.

11. A ratchet wrench comprising a handle with a head connected thereto, an opening being formed in the head, a pawl being disposed in a portion of the opening, the pawl having a keying means formed therein, a reversing lever having a stem formed on a bottom surface, the stem having an engaging means formed thereon, a retaining plate having an aperture formed therein, the aperture being aligned with the keying means in the pawl, the reversing lever being disposed in the portion of the opening in the head such that the stem extends through the opening in the retaining plate and is received in the keying means in the pawl, wherein the reversing lever is rotated and is retained by the retaining plate and further wherein pivotal movement of the reversing lever produces concomitant pivotal movement of the pawl to provide forward and reverse ratcheting of the wrench.

12. The ratchet wrench of claim 11, wherein the opening formed in the head is formed from a top surface of the head, the opening having two overlapping portions, a first portion being distal from the handle and being a through opening, the second portion being a blind bore proximal to the handle, the pawl being disposed in the second portion.

13. The ratchet wrench of claim 11, wherein the stem on the reversing lever is formed as an undercut tang, the undercut tang securing the reversing lever to the retaining plate, the keying means in the pawl being a recess formed in a top surface of the pawl wherein the tang on the reversing lever engages the recess on the top surface of the pawl.

14. A ratchet wrench comprising a handle with a head connected thereto, an opening being formed in the head, a pawl being disposed in a portion of the opening, the pawl having a keying means formed therein, a reversing lever having a stem formed on a bottom surface, the stem having an engaging means formed thereon, a retaining plate having an aperture formed therein, the aperture being aligned with the keying means in the pawl, the reversing lever being disposed in the portion of the opening in the head such that the stem extends through the opening in the retaining plate and is received in the keying means in the pawl, wherein the stem has at least one barb formed thereon, the at least one barb forming a snap fit with the retaining plate, wherein the reversing lever is rotatable and is retained by the retaining plate and further wherein pivotal movement of the reversing lever produces concomitant pivotal movement of the pawl to provide forward and reverse ratcheting of the wrench.

15. A ratchet wrench comprising a handle with a head connected thereto, an opening being formed in the head, a pawl being disposed in a portion of the opening, the pawl having a keying means formed therein, a reversing lever having a stem formed on a bottom surface, the stem having an engaging means formed thereon, a retaining plate having an aperture formed therein, the aperture being aligned with the keying means in the pawl, the reversing lever being disposed in the portion of the opening in the head such that the stem extends through the opening in the retaining plate and is received in the keying means in the pawl, wherein the pawl has a recess formed on a lower surface thereof, the stem of the reversing lever having a flexible barb formed on an end thereof, the barb engaging the recess in the pawl, wherein the reversing lever is rotatable and is retained by the retaining plate and further wherein pivotal movement of the reversing lever produces concomitant pivotal movement of the pawl to provide forward and reverse ratcheting of the wrench.

16. A ratchet wrench having a handle and a head connected thereto, the head having a top surface, a bottom surface and an opening therebetween, comprising in combination:

the opening being formed from the top surface of the head, the opening having two overlapping portions, a first portion being distal from the handle and being a through opening, the second portion being a blind bore proximal to the handle, a gear having a top surface and a bottom surface, a tang formed on the bottom surface thereon, the gear being disposed in the first portion of the opening with the tang extending from the bottom surface of the head, a pawl being disposed in the second portion of the opening in the head and engaging the gear, a retaining plate being disposed over the gear and the pawl and being received in the opening in the head retaining the gear and the pawl in the opening in the head, the tang on the gear having a transverse opening therein, a first detent ball being disposed in the transverse opening wherein a socket is removably retained on the tang, a blind bore being formed axially in the gear and extending into the tang, the blind bore communicating with the transverse opening and being perpendicular thereto, a resilient means being disposed in the blind bore supporting a second detent ball, the second detent ball contacting the first detent ball, a shaft having a first end and a second end being disposed in the blind bore in the gear, the first end abutting the second detent ball, the second end being connected to a button, the button extending outwardly from top surface of the gear, the button having a flange integrally formed on a bottom surface thereof, the flange being disposed and retained with a snap interface in the blind bore in the gear, wherein pressure on the button compresses the resilient means and moves the second detent ball lower in the blind bore such that the first detent ball moves toward the blind bore and releases the socket from the tang.

17. The ratchet wrench of claim 16, wherein the flange on the button is disposed beneath and abutting the retaining plate.

18. The ratchet wrench of claim 16, wherein the blind bore in the gear has an upper portion having an undercut forming a circumferential ledge within the bore, the flange on the button being disposed beneath the ledge.

19. The ratchet wrench of claim 16, wherein the flange on the button has a diameter, the retaining plate having an opening therein, said opening having a diameter smaller than the diameter of the flange, such that the button is retained within the blind bore.

20. In a ratchet wrench having a head portion provided with a ratchet gear and pawl, the improvement comprising a retaining plate secured to the head portion and retaining at least the pawl, a reversing lever having an integral depending tang, the retaining plate being provided with an opening therein having a cross-section which is complementary to, and larger than, the cross-section of the integral depending tang on the reversing lever, and the pawl having an opening formed therein which has a cross-section complementary to the cross-section of the integral depending tang on the reversing lever such that the integral depending tang on the reversing lever may slide through and clear the retaining plate, and such that the reversing lever may then be turned through an angle to enable the integral depending tang on the reversing lever to slide into and engage the opening formed in the pawl and become keyed thereto, thereby connecting the reversing lever to the pawl for conjoint pivotal movement in unison, and thereby preventing the reversing lever from becoming disengaged from the pawl.

21. The improvement of claim 20, wherein the integral depending tang and the respective openings in the retaining plate and pawl each has a rectangular cross-section, and wherein the reversing lever is turned approximately 90°.

22. In a ratchet wrench, the combination of a wrench handle having a head portion provided with a transverse bore and a communicating counterbore opening to the top surface of the head portion of the wrench handle; a ratchet gear, disposed within the counterbore, and having a drive tang passing through the bore and beyond the bottom surface of the head portion of the wrench handle; the head portion of the wrench handle being further provided with a blind transverse bore formed therein, anteriorly of the counterbore, and communicating therewith; a pawl within the blind transverse bore and engaging the ratchet gear; a retaining plate received within the head portion of the wrench handle for retaining the ratchet gear and pawl, respectively; a reversing lever having an integral depending stud passing freely through an opening in the retaining plate, keyed to the pawl for rotation in unison, and prevented from being disengaged therefrom; and a snap ring engaging an internal annular groove in the head portion of the wrench handle, above the retaining plate, and retaining the retaining plate; such that the ratchet gear, pawl, retaining plate and reversing lever are all loaded from the top of the ratchet wrench and retained by the snap ring, thereby simplifying the assembly of the ratchet wrench.

* * * * *